US005318186A

United States Patent [19]

Rienecker

[11] Patent Number: 5,318,186

[45] Date of Patent: Jun. 7, 1994

[54] DOUBLE SCREEN BASKET APPARATUS

[75] Inventor: Reimund Rienecker, Heidenheim, Fed. Rep. of Germany

[73] Assignee: J.M. Voith GmbH, Fed. Rep. of Germany

[21] Appl. No.: 969,724

[22] Filed: Oct. 29, 1992

[30] Foreign Application Priority Data

Oct. 31, 1991 [DE] Fed. Rep. of Germany ..... 4135854

[51] Int. Cl.[5] ..... B07B 1/04

[52] U.S. Cl. ..... 209/273; 209/306; 209/414; 209/372

[58] Field of Search ..... 209/305, 306, 273, 289, 209/290, 291, 292, 372, 414

[56] References Cited

U.S. PATENT DOCUMENTS

| | | | |
|---|---|---|---|
| 3,713,536 | 1/1973 | Hooper | 209/306 X |
| 3,785,495 | 1/1974 | Holz | 209/273 X |
| 3,898,157 | 8/1975 | Hooper | 209/306 |
| 4,302,327 | 11/1981 | Martin | 209/240 |
| 4,440,635 | 4/1984 | Reiniger | 209/306 X |
| 5,009,774 | 4/1991 | LeBlanc | 209/306 X |
| 5,119,953 | 6/1992 | Atkeison, III et al. | 209/273 |

*Primary Examiner*—D. Glenn Dayoan

*Attorney, Agent, or Firm*—Marshall, O'Toole, Gerstein, Murray & Borun

[57] ABSTRACT

A screening apparatus is disclosed having at least one housing attachment element and a main housing element, each of which has a hollow cylindrical and/or truncated-cone-shaped housing outer wall. The apparatus includes at least two coaxial, predominantly rotationally symmetrical screen baskets and a rotor having pulsation elements. An accepts chamber is disposed radially outside the screen baskets and the rotor and pulsation elements are disposed radially inside the screen baskets. An inlet of the housing is disposed centrally in the area between the screen baskets and an outlet channel allowing for access in the area between the two screen baskets. The invention is characterized in that at least in the area of the screen baskets, only one main housing element and one attachment element are provided and that the first screen basket is disposed in the attachment element and the second screen basket is disposed in the main housing element.

13 Claims, 3 Drawing Sheets

DOUBLE SCREEN BASKET APPARATUS

FIELD OF THE INVENTION

The invention relates to screening apparatus and, more particularly, the invention relates to a screening apparatus having at least two coaxial screen baskets mounted within a two-piece housing.

DESCRIPTION OF THE RELATED TECHNOLOGY

A screening apparatus is known from EP 36,329, published Sep. 23, 1981 (which corresponds to Martin, U.S. Pat. No. 4,302,327, issued Nov. 24, 1981). Such an apparatus has at least two housing elements, each of which has a hollow-cylindrical and/or truncated-cone-shaped housing outer wall, with at least two coaxial, predominantly rotationally symmetrical screen baskets, a rotor having pulsation elements with an accepts chamber disposed radially outside the screen baskets and the rotor and pulsation elements disposed radially inside the screen baskets. Such an apparatus includes an inlet of the housing and an accepts outlet channel disposed in an area between top and bottom portions of the apparatus, each portion containing a screen basket. One problem with such a screening apparatus is access to the screen baskets for inspection purposes.

SUMMARY OF THE INVENTION

An object of the invention is to overcome the foregoing problem which is solved by the features of the invention.

The screening apparatus of the invention includes only one main housing element and one housing attachment element in the area of the screen baskets with a first screen basket being disposed in the housing attachment element and a second screen basket being fastened in the main housing element.

An apparatus according to the invention provides the advantage of having an axially outermost edge of the housing attachment element or a corresponding housing shell in the area of the joint between the housing attachment element and the main housing element preferably to end with a deviation of no more than 20 mm with a corresponding axially outermost edge of a corresponding screen basket. Provision can then favorably be made for the inlet to be provided, like the outlet, at the main element of the housing so that no dismantling of additional piping is necessary when the housing attachment element is removed from the main element of the housing. However, the piping for a rejects discharge of the housing attachment element would have to be removed when the screen baskets are inspected, which would include the removal of a deaeration pipe.

The apparatus according to the invention provides holding devices in two different vertical planes, providing means of transport of the housing attachment element. Thus, the housing attachment element can be turned after removal from the main housing element so that a screen basket is freely accessible. The holding devices disposed in the area of the housing outer wall can also be designed so that they serve as stand-on elements during inspection.

BRIEF DESCRIPTION OF THE DRAWINGS

The invention is further explained on the basis of the following drawings.

DETAILED DESCRIPTION OF THE INVENTION

Figure 1:
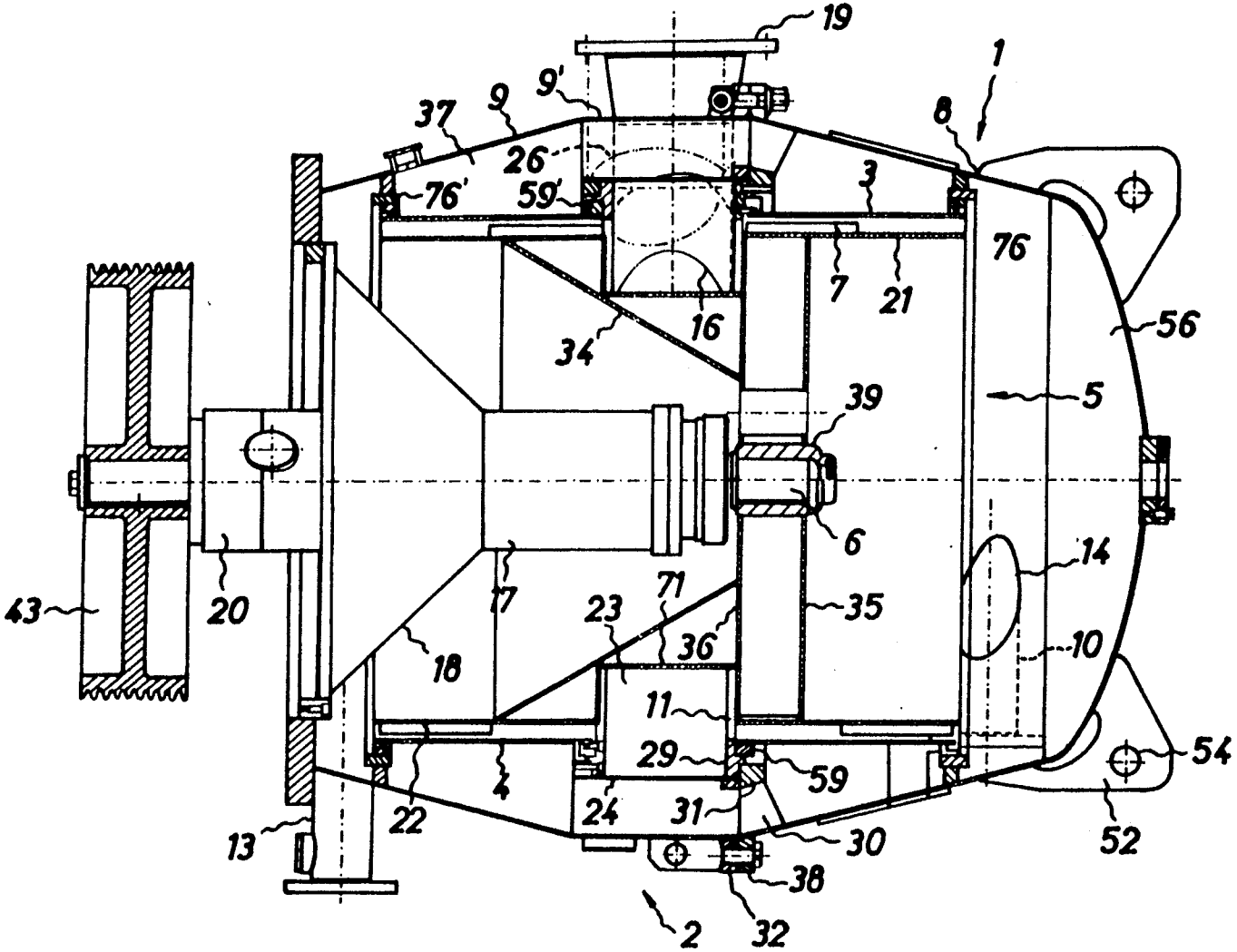
FIG. 1 is an axial section of a screening apparatus according to the invention.

In FIG. 1 a horizontal configuration of an apparatus according to the invention is shown, including a housing attachment element 1, a main housing element 2, horizontally aligned screen baskets 3 and 4, a rotor 5 including a rotor shaft 6 and pulsation elements 7, and a vertical housing joint.

The housing attachment element 1 is fastened to the main housing element 2 and is, in a similar way to the main housing element 2, designed with a truncated, cone-shaped housing outer wall 8, in which the screen basket 3 can be mounted via housing-side and screen-side supporting rings. By means of a clamping ring 29, the first screen basket 3 is secured to the main housing element 2. The housing attachment element includes a supporting ring 30 to which a supporting ring 31 of the corresponding main housing element 2 is fastened. The screen baskets are guided to slide at their other ends by their respective end-side fastening rings on radial annular surfaces of end-side fastening rings 76 and 76' of the respective housing element.

A housing outer wall 9 of the main housing element 2 is likewise designed in the shape of a truncated cone in the area away from the joint between the housing elements 1 and 2, and includes a cylindrical element 9'. Connected to the cylindrical element 9' are both an outlet chamber for the accepts material having an outlet opening 26 and an inlet opening 16 which leads to an inlet branch 19. In this area, which is located in the vicinity of the cylindrical wall element 9' of the housing outer wall 9, there is a cylindrical separating wall 24, which, by means of the clamping ring 29 for the first screen basket 3 and a corresponding clamping ring for the other screen basket 4 (see also supporting ring 31), separates an inlet chamber 23 from an accepts chamber 37. The (here vertical) axial outermost edge of the housing outer wall 8 terminates nearly at the same location (here, the same vertical plane) as an axial outermost edge 11 of the first screen basket 3. In this area, it is preferred that there should be only a slight deviation between the termination of the wall 8 and the edge 11 of a maximum of 150 mm, generally, however, much less is preferred. In light of the configuration of the inlet and the outlet, it is appropriate to dimension the deviation at most with 20 mm. The housing attachment element 1 is connected to the main housing element 2 by means of bolts and flanges 32 and 38 respectively; a special housing cover is superfluous.

If the housing joint and the end surface of the supporting ring 31 lie in one plane, the sealing of the inlet chamber 23 can be created easily by suitable machining of these surfaces and of the separating wall 24.

The supporting elements 30 and 31 of the housing attachment element 1 and a supporting element 57 of the superstructure 1' (shown in FIG. 3) of the first screen basket 3 and 3' respectively, are fastened and axially fixed to an end ring 59. It is furthermore also desirable that the housing attachment element 1 with supporting elements 30 and 31 or the superstructure 1' with supporting element 57 have edges or ends extending approximately to the end of the first screen basket 3 or 3' or deviate from the screen basket edge up to a maximum of 20 mm plus the thickness of the end ring 59. The ends of the supporting elements also extend to near the other screen basket 4 or 4' or an end ring 59'.

The main housing element 2 is supported by means of supporting feet 44 and 45 on a foundation 41. The housing attachment element 1 and the rotor are mounted on the main housing element 2 and are thus also carried by the supporting feet 44 and 45.

The inlet chamber 23 supplies a suspension to a screen chamber disposed between cylindrical elements 21 and 22 of the rotor 5 and the respective screen baskets 3 and 4. The screening or pulsating elements 7 of the rotor are disposed in the screen chamber.

The rotor is held by a shaft 6, which is mounted on bearing elements 17 and 20 as well as a truncated-cone-shaped bearing element 18 by means of ball or plain bearings in the main housing element 2. The rotor shaft is driven via a belt pulley 43. The rotor 5 is connected to the rotor shaft 6 by a sleeve 39 by means of ribs 35 and 36 as well as a truncated-cone-shaped intermediate element 34.

In a preferred configuration, the housing attachment element 1 is designed as a single piece with a cover wall 56 of the screening apparatus, with the accepts chamber 37 being disposed radially outside the screen baskets 3 and 4 and the rotor element (rotor elements) with the pulsation elements 7 being disposed radially inside the screen baskets 3 and 4.

The outflows for the rejects material (i.e. more precisely the screen overflow) are designated by reference numerals 10 and 13, with an outlet opening of the housing attachment element 1 indicated at reference numeral 14.

Holding devices 49 for the housing attachment element 1 are designed as ribs. Other supporting elements for transport of the attachment element 1 are laterally projecting ribs 52 with holes 54. The ribs 52 also serve as stand feet. By this means (devices 49 and ribs 52), the housing attachment element 1 hanging on hooks can be turned through 90° so that the first screen basket 3 is easy to access for inspection purposes and, when required, can also be easily removed.

The main housing element 2 includes transport lugs 55 and 58. Additional feet 60 can be provided to possibly facilitate mounting of the screen basket 4 and also of the rotor or its bearing assembly, by standing the main housing element 2 upright.

Figure 2:
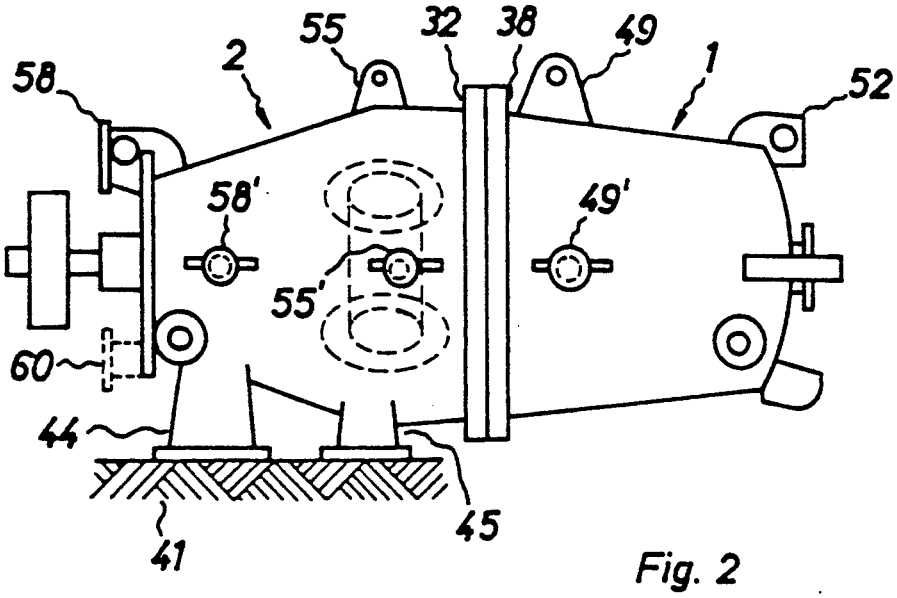
FIG. 2 is a side elevational view of the screening apparatus according to FIG. 1.
Figure 3:
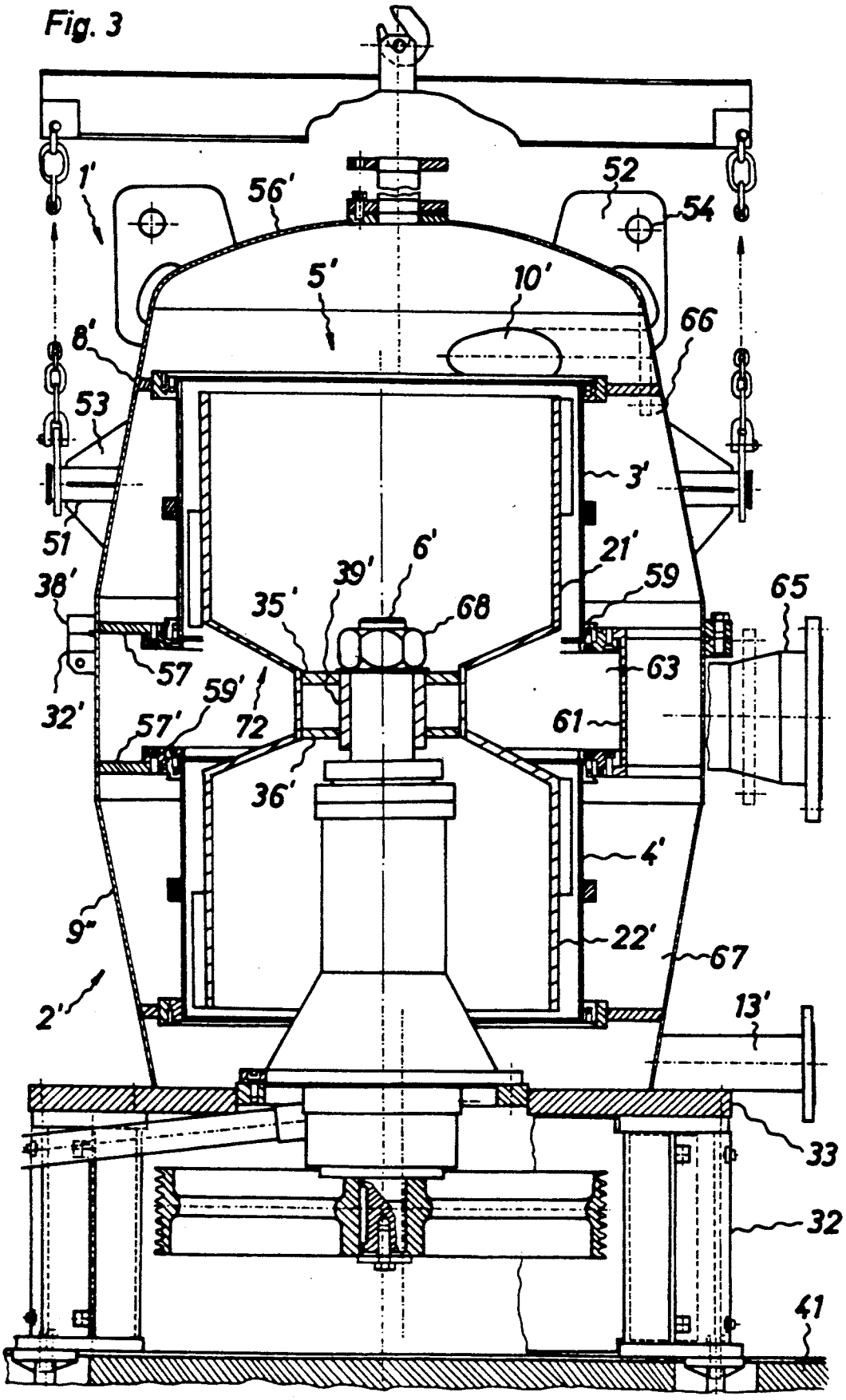
FIG. 3 is an axial section of another embodiment of a screening apparatus according to the invention.

Transport devices 51 and 53 of FIG. 3 can also be replaced by corresponding transport devices 55' and 58' and/or the transport devices 55 and 58 of FIG. 2.

A vertical configuration of the housing elements, screen baskets and rotor according to the invention is shown in FIG. 3, which includes the same or similar elements as in FIG. 1 with the same reference symbols shown with an apostrophe. The embodiment shown in FIG. 3 differs from the embodiment shown in FIGS. 1 and 2 with respect to the housing foot configuration, the inflow area and the type of drum design. Also FIG. 3 shows an eccentric cooperation between a screen housing and a rotor 5' and baskets 3' and 4,, as is evident from the offset of the two faintly indicated centerlines of the figure. The offset is at least 30 mm, with a center axis of the housing shifted in relation to a rotor axis in the direction of an accepts outlet 65. Due to this offset, a space in the area of the accepts outlet is enlarged where the accepts material flows from the first screen basket 3' and the second screen basket 4', i.e. where material in respective accepts chambers 66 and 67 flow towards each other and then combine in the accepts outlet 65.

The configuration shown in FIG. 3 also applies to a horizontal type of installation of the apparatus, i.e. all cross-section figures are suitable for both vertical and horizontal installation.

A housing lower element 2' is supported on the foundation 41 by means of a bottom supporting plate 33 on bearing columns 32.

Holding devices for an attachment (here, upper) housing element 1' are disposed in a lower plane of the element 1' and are designed as supporting cylinders 51 held and reinforced by ribs 53 on the housing element 1'. The supporting elements adapted for use as transport elements of an upper plane of the element 1' are upward-pointing ribs 52 with holes 54. The upper housing element 1' hanging on hooks can thus be turned through 180° so that the upper screen basket 3' is easily accessible for inspection purposes and, where required, can also be easily removed.

Provision can also appropriately be made for easy turning of the upper housing element 1' in that the center of the supporting cylinders (i.e., suspension devices) 51 mounted on the upper housing element 1' include hooks or loops adapted for holding chains or ropes in the horizontal plane of the center of gravity of the upper housing element 1', including the upper screen basket 3' or at most, at approximately 100 mm higher than this plane at the upper element 1'. It is also preferred that the upper housing attachment element 1' be designed in one piece with a cover wall 56', i e. no special housing cover exists.

An inflow chamber is defined by one upper and one lower horizontal plate 57 and 57', respectively, each connected to the respective housing element 1' or 2'. The inflow chamber is further defined by a vertical, predominantly circularly bent separating wall 61 disposed mainly in the area of the accepts outlet 65. Outlet nozzles for the screen overflow, fitted in the same way as in FIG. 1 are also evident here and are designated by reference numerals 10' and 13' respectively.

From FIGS. 1 and 3 it can be seen that the rotor drums 21 and 22 and 21' and 22' respectively are connected in one unit and have a very smooth surface, with a flat flute 71 (in FIG. 1) Or 72 (in FIG. 3) disposed between the rotor drums in order to considerably enlarge the inflow chamber 23 and 63 respectively for the suspension. The rotor drums are connected according to FIG. 3 by supporting ribs 35' and 36' to a supporting sleeve 39' and fastened to a shaft 6' by means of nuts 68.

With regard to all the embodiments of the invention, it is essential that the supporting joint of the housing attachment element, that is, the end edge of the supporting ring 31 in FIG. 1 and the supporting plate 57 for the screen basket 3' of FIG. 3, ends at approximately the same location as the corresponding end edge of the screen basket or a supporting ring of the same fastened to it, with only a minor deviation in axial direction. This edge is marked with the reference numeral 11 in FIG. 1. A maximum deviation of approximately 30 to 50 mm between these two edges upwards and downwards is acceptable, whereby this deviation can fluctuate in this area with the design embodiment and possibly amount up to 40 mm. The joint between the outer walls 8 and 9, and 8' and 9'. respectively of the housing elements may of course shift somewhat more, especially in the direction of the housing attachment element 1 or 1'. This depends entirely on the embodiment of the accepts discharge nozzle 65 and/or the inlet nozzle 19 with regard to its diameter and fundamental configuration. However, these deviations do not change the fact that the first screen basket is clamped to the housing attachment element, and after separation of the two housing halves by turning of the housing attachment element, the first screen basket becomes freely accessible for inspection and installation purposes.

Figure 4:
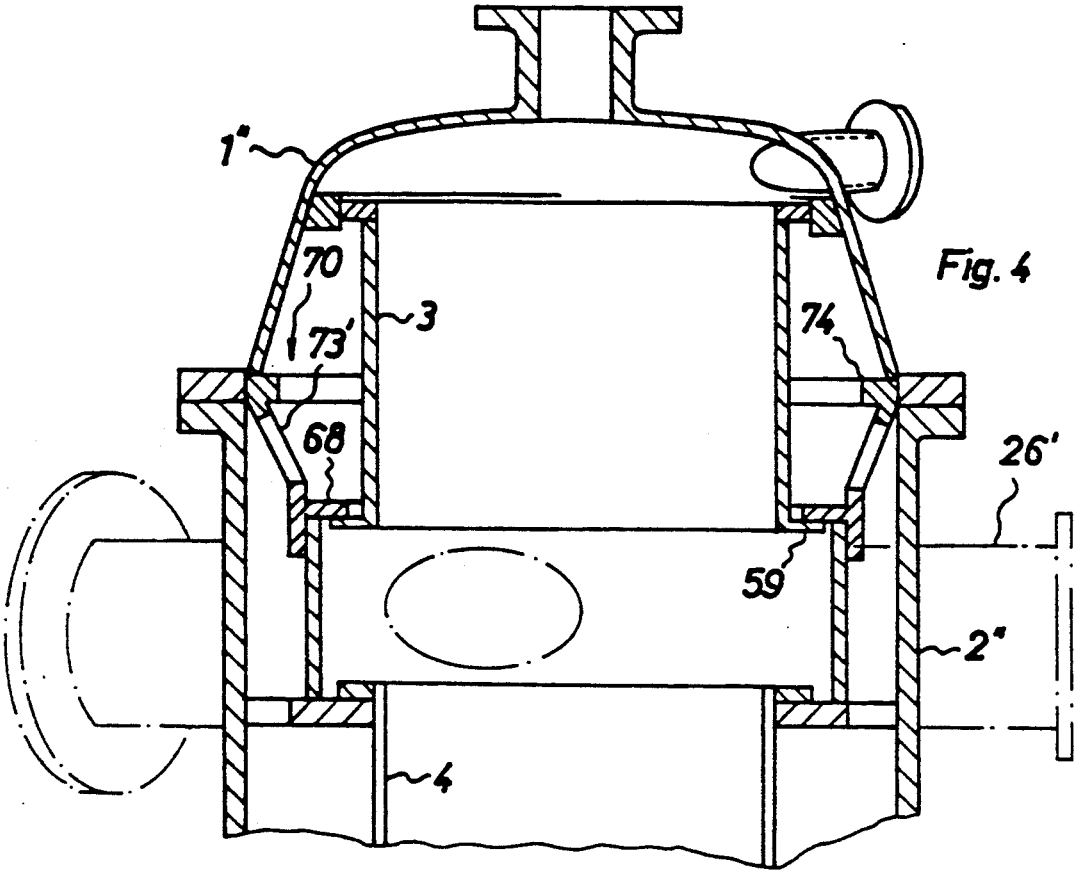
FIG. 4 is a partial, axial section of a third embodiment of a screening apparatus according to the invention.

FIG. 4 shows an embodiment according to the invention having a relatively "short" housing attachment element or upper element 1" with a rib configuration 70 for fastening a screen basket 3" which is firmly screwed or otherwise attached to a (radial inner) supporting ring 68. Between ribs 73 there are through-flow cross-sections from an accepts chamber to an outflow opening 26'. Otherwise the inner construction (and for the most part also the outer construction) of the screening apparatus shown in FIG. 4 corresponds to that according to FIG. 1.

I claim:

1. A screening apparatus comprising a housing attachment element and a main housing element, each such element having a hollow housing outer wall and said apparatus having a joint between such elements, said screening apparatus further comprising first and second coaxial, predominantly rotationally symmetrical screen baskets, a rotor having pulsation elements, an accepts chamber disposed radially outside the screen baskets and the rotor and pulsation elements disposed radially inside the screen baskets, an inlet of the housing disposed centrally in an area between the screen baskets, and an accepts outlet channel disposed in the area between the screen baskets, wherein at least in the area of the screen baskets only one main element and one attachment element is provided with the first screen basket being disposed in the attachment element and the second screen basket being disposed in the main element.

2. The screening apparatus according to claim 1 wherein the inlet and the accepts outlet are disposed in the main element.

3. The screening apparatus according to claim 1 comprising an annular inlet chamber defined by a generally cylindrical blocking wall and by a first supporting ring connected to the outer wall of the housing attachment element for attachment of the first screen basket and a corresponding second supporting ring connected to the outer wall of the main housing element for attachment of the second screen basket.

4. A screening apparatus according to claim 3, wherein the screen baskets are held near the housing joint by ribs with the first supporting ring being connected to the housing outer wall of the housing attachment element.

5. A screening apparatus according to claim 1 comprising first and second accepts chambers, each accepts chamber having an outlet opening and an accepts discharge outlet, wherein an inlet chamber is defined by a first supporting plate, a second supporting plate and an arched separating wall, the first supporting plate being adapted to hold the first screen basket connected to the outer wall of the housing attachment element and the second supporting plate being adapted to hold the second screen basket connected to the outer wall of the main element, the separating wall being oriented generally vertically when the baskets are in a vertical configuration and generally horizontally when the screen baskets are in a horizontal configuration, said separating wall being disposed in the area of the outlet openings of the first and second accepts chambers and leading to the accepts discharge outlet in the area of the inlet of the housing, and wherein the outer wall of the housing attachment element and the main housing element is predominantly rotationally symmetrical and has a rotationally symmetrical axis, the outer wall of the housing attachment element and the outer wall of the main housing element being offset by at least 30 mm in relation to a central axis of the first and second screen baskets and the rotor in a direction towards the accepts discharge outlet.

6. A screening apparatus according to claim 5 wherein the first supporting plate is disposed in the housing attachment element and is adapted to axially fix the first screen basket to the housing attachment element, the first supporting plate having ends extending approximately to an end edge of the first screen basket, deviating a maximum of about 20 mm plus the thickness of an end ring therefrom, and also extending near the second screen basket.

7. A screening apparatus according to claim 1 wherein the rotor comprises two axial drums adapted to carry the pulsation elements, each axial drum and a corresponding screen basket defining a sleeve-shaped screen chamber and wherein between the two drums there is an enlarged inlet chamber defined by a flat flute, the chambers being connected to the inlet of the housing elements.

8. A screening apparatus according to claim 7 wherein at least one drum is disposed in the housing attachment element is covered and closed by a plate.

9. A screening apparatus according to claim 1 wherein the housing attachment element is designed in one piece.

10. A screening apparatus according to claim 1 including a guide defined by a radial inner ring surface of a ring disposed at an end of the screen baskets, away from the housing joint.

11. A screening apparatus according to claim 1 including a ring for supporting the first screen basket, said ring disposed near the inlet of the housing and on a supporting rib structure fastened to the housing attachment element.

12. A screening apparatus according to claim 1 wherein in the area of the housing joint, an axially outermost edge of the outer wall of the housing attachment element is disposed in the area of an axially outermost edge of the first screen basket and is axially offset thereof up to about 150 mm.

13. A screening apparatus according to claim 3 wherein the first supporting ring is disposed in the housing attachment element and is adapted to axially fix the first screen basket to the housing attachment element, the first supporting ring having ends extending approximately to an end edge of the first screen basket, deviating a maximum of about 20 mm plus the thickness of an end ring therefrom, and also extending near the second screen basket.

* * * * *